United States Patent [19]

Inoue

[11] Patent Number: 4,678,344

[45] Date of Patent: Jul. 7, 1987

[54] ELECTRONIC TIMEPIECE

[75] Inventor: Yuichi Inoue, Tokyo, Japan

[73] Assignee: Seiko Instruments & Electronics Ltd., Tokyo, Japan

[21] Appl. No.: 829,391

[22] Filed: Feb. 13, 1986

[30] Foreign Application Priority Data

Feb. 14, 1985 [JP] Japan ..... 60-26881

[51] Int. Cl.[4] ..... G04C 17/00

[52] U.S. Cl. ..... 368/69; 368/10; 368/187

[58] Field of Search ..... 368/10, 187, 69, 185–187, 368/188, 189, 41, 42, 319, 320

[56] References Cited

U.S. PATENT DOCUMENTS

| | | | |
|---|---|---|---|
| 4,086,654 | 4/1978 | Ido et al. | 368/10 |
| 4,209,976 | 7/1980 | Flumm | 368/187 |
| 4,246,650 | 1/1981 | Moritani et al. | 368/69 |
| 4,253,177 | 2/1981 | Hafner | 368/187 |
| 4,451,159 | 5/1984 | Tanaka | 368/69 |

*Primary Examiner*—Bernard Roskoski

*Attorney, Agent, or Firm*—Bruce L. Adams; Robert E. Burns; Emmanuel J. Lobato

[57] ABSTRACT

Is disclosed an electronic watch which conducts switch operation by rotating the annular dial of the outer case, wherein the rotation direction and the rotation position of the annular dial is made possible to detect accurately by providing electric pattern on the reverse side of the annular dial and a switch pin on the body side of the watch whereby a large number of modes are establishable.

2 Claims, 6 Drawing Figures

FIG. 4

| SWITCH \ POSITION | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| SWITCH A (8a) | 1 | 1 | | 1 | | | 1 | | | 1 | | | 1 | | | 1 |
| SWITCH B (8b) | | 1 | | | 1 | 1 | | 1 | | | 1 | | | 1 | | |
| SWITCH C (8c) | | | 1 | | | 1 | | | 1 | 1 | | 1 | | | 1 | |

| SWITCH \ POSITION | G | H | I | J | K | L | M | N | O | P | Q | R | S | T | U | V |
|---|---|---|---|---|---|---|---|---|---|---|---|---|---|---|---|---|
| SWITCH A(8a) | | | 1 | | | 1 | | | 1 | | | 1 | | | 1 | |
| SWITCH B(8b) | 1 | | | 1 | | | 1 | | | 1 | | | 1 | | | 1 |
| SWITCH C(8c) | | 1 | | | 1 | | | 1 | | | 1 | | | 1 | | |

| SWITCH \ POSITION | W | X | Y | Z | ) | ( | + | − | x | ÷ | = | : | . | , | ? | |
|---|---|---|---|---|---|---|---|---|---|---|---|---|---|---|---|---|
| SWITCH A(8a) | 1 | | | 1 | | | 1 | | | 1 | | | 1 | | | 1 |
| SWITCH B(8b) | | 1 | | | 1 | | | 1 | | | 1 | | | 1 | | |
| SWITCH C(8c) | | | 1 | | | 1 | | | 1 | | | 1 | | | 1 | |

| | |
|---|---|
| 1 | ··· on |
| | ··· off |

ELECTRONIC TIMEPIECE

BACKGROUND OF THE INVENTION

1. Field of the Invention

The present invention relates to an electronic timepiece having a rotary annular dial which coacts with a switch input circuit for inputting data.

2. Description of the Prior Art

Conventionally, a switch input mechanism which coacts with an annular dial in an electronic watch has been a mechanism having switch pins which move up and down by means of projected and recessed portions of the annular dial and so that the switch turns ON/-OFF. For example, a switch input mechanism of this type is disclosed in U.S. Pat. No. 4,451,159, issued May 29, 1984 to Tanaka.

In the conventional type of switch input mechanism using an annular dial, the maximum mode number which can be distinguished by the number of switch pins is limited. For example, when there were four switch pins, the mechanism could establish only up to 12 modes at the maximum. Generally, assuming that the number of switch pins is n, the establishable maximum mode number will be $n\times(n-1)$ when $n\geqq 3$. However the number of switch pins is limited to four, and it was actually impossible to increase the number of switch pins. Also, as the switch pins are arranged to move up and down by the projected and recessed portions of the annular dial, it was structurally impossible to establish more than 12 patterns of projected and recessed portions. Therefore the conventional switch input mechanism using a rotary annular dial has the disadvantage of not being able to establish more than 12 modes.

SUMMARY OF THE INVENTION

To overcome the above disadvantage, the present invention forms electric patterns directly on the annular dial, and the ON/OFF operation is not made by up and down movement of the switching pins but instead by the switching pins making and breaking electrical contact with the electric pattern on the annular dial.

Another object of this invention is to provide an electronic timepiece capable of establishing more than 60 modes by providing an electric pattern on the annular dial. By providing three switch pins, and by detecting the rotation direction and the rotation position of the annular dial by the ON/OFF of the switch pins, only three switch pins are necessary, and the position of the switch pins can be established more freely as compared to the conventional method.

Still another object of this invention is to provide an electronic timepiece which avoid mis-detection of the rotation direction and the rotation position of this annular dial by established three positions wherein the ON/-OFF operation of the three switch pins and the position of the annual dial correspond by one to one. With this method, even when a mis-detection does occur and the value of the counter and the position of the annular dial do not match each other, the position of the annular dial is made to coincide with the value of the counter when the annular dial passes over one of the three positions.

BRIEF DESCRIPTION OF THE DRAWING

FIG. 4 is position table of the annular dial and the ON/OFF condition of the switches.

PREFERRED EMBODIMENT OF THE INVENTION

Figure 1:
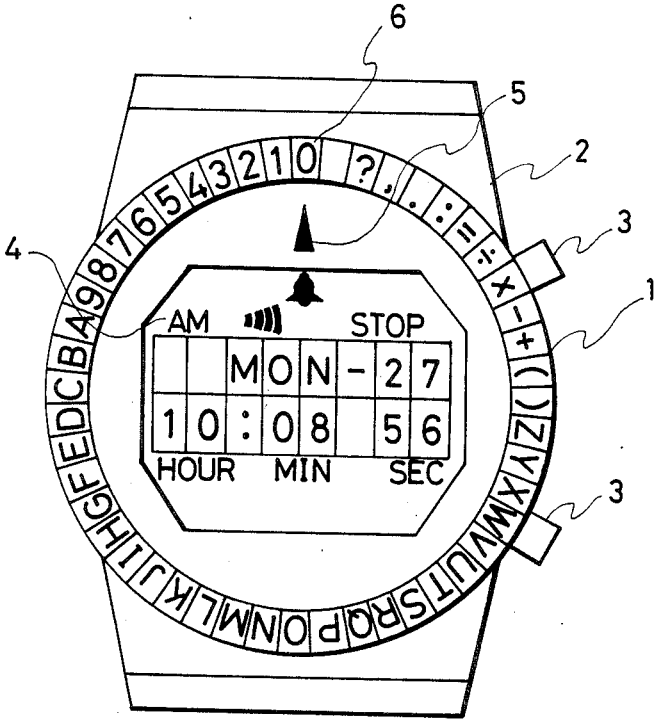
FIG. 1 is a plan view showing an embodiment of the present invention utilized in a memo watch.

FIG. 1 is a plan view showing an embodiment where the present invention is used in a memo watch. Reference characters 6 (letters, numbers and signs, 48 in all) with which one can take notes are arranged around the periphery of an annular dial 1. When a user wants to take a note, he can rotate the annular dial 1 and set it to the desired character 6 and thus it is possible to input the memo.

Figure 2:
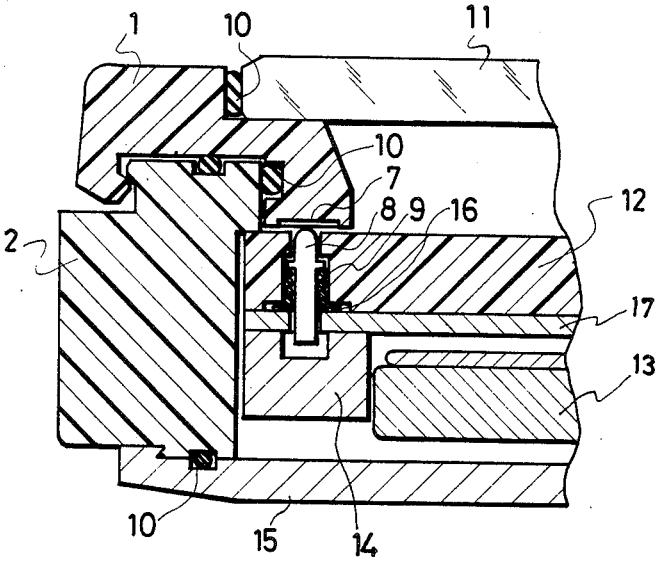
FIG. 2 is a sectional view of the watch shown in FIG. 2.

FIG. 2 is a sectional view of a memo watch according to an embodiment of the present invention. The watch has an outer case 2 which is made water-proof by packings 10 a glass 11, and a rear case 15. Switch pins 8 are provided inside a panel frame 12, and switch pin is urged by a spring 9 against an electric pattern 7 on the annular dial 1. The spring 9 also presses against a circuit pattern 16 mounted on a circuit base plate 17 and serves as the electrical path between the switch pin 8 and the circuit pattern 16. When the annular dial 1 is rotated, the switch pins 8 repeatedly make and break contact with the electric pattern 7 on the annular dial 1, and the ON/OFF operation of the circuit pattern 16 is effected.

Figure 3:
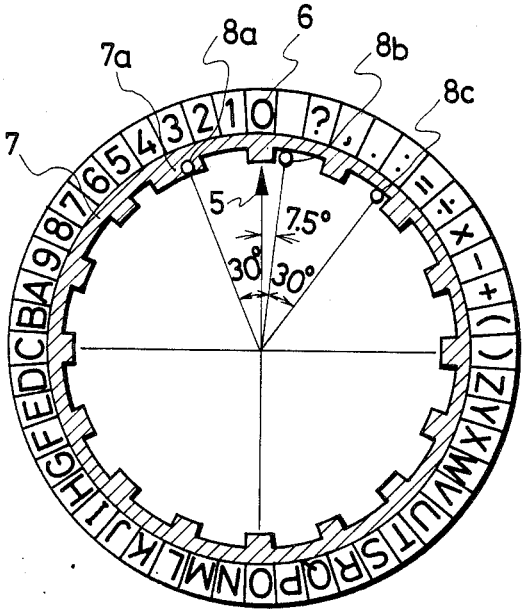
FIG. 3 is a plan view showing an embodiment of electric patterns.

FIG. 3 is a view of the electric pattern 7 provided on annular dial 1 as seen from above showing an embodiment of the positions of switch pins A to C (8*a* to 8*c*). The electric pattern 7 comprises a succession of angularly spaced electrically conductive pattern portions separated by non-conductive portions, the conductive pattern portions all being commonly connected to a conductive ring. Switch pins A to C (8*a* to 8*c*) repeatedly make and break electrical contact with the electric pattern 7 provided on the annular dial 1 by the rotation of the annular dial, and thereby carry out the ON/OFF operation of the circuit pattern 16. The position of the annular dial 1 shown in FIG. 3 is at the (0)—position of the letter mark 6, and in this state the switch pins A to C (8*a* to 8*c*) are at ON, OFF, and OFF conditions (i.e., make, break and break conditions) respectively. Numeral 7*a* denotes the position where the electric pattern 7 is irregular. With this irregular position 7*a*, the ON/-OFF condition of the switch pins A to C (8*a* to 8*c*) is determined particularily at their positions of the annular dial 1, while the annular dial 1 rotates once. FIG. 3 shows an embodiment in which the annular dial is divided into 48 parts, but there is no requirement of dividing it into 48 parts, so long as it is divided into a number of parts which is a multiple of 3, in case that there are three switch pins. Also, the position of the switch pins A to C (8*a* to 8*c*) need not to be at the positions shown in FIG. 3, but can be established at positions of an angular degree multiple of 22.5 degree apart from the points shown in FIG. 3.

FIG. 4 is a position table of the annular dial 1 and the ON/OFF condition of switch pins A to C (8*a* to 8*c*). From the drawing, it can be understood that one of the three switches is always made to be ON. When the annular dial 1 is rotated one increment for 1 click, one of the two switches that were OFF turns ON, and the switch which was ON turns OFF. Utilizing this mechanism, the rotation direction, rotating whether to the right or to the left, can be judged by the input circuit as explained below. Owing to the existence of the irregular position 7*a* of the electric pattern 7, when the annular dial is turned to positions of "1", "5", "9", two of the three switches turn ON and the other one turns OFF, so that the position of annular dial 1 is determined by the ON/OFF condition of the switches. At the positions of "1", "5", and "9" of the annular dial, the input circuit (described below) sets the counter to respective values, and this circuit lets the value of the counter coincide with the position of the annular dial 1 even when there is a mis-detection.

Figure 5:
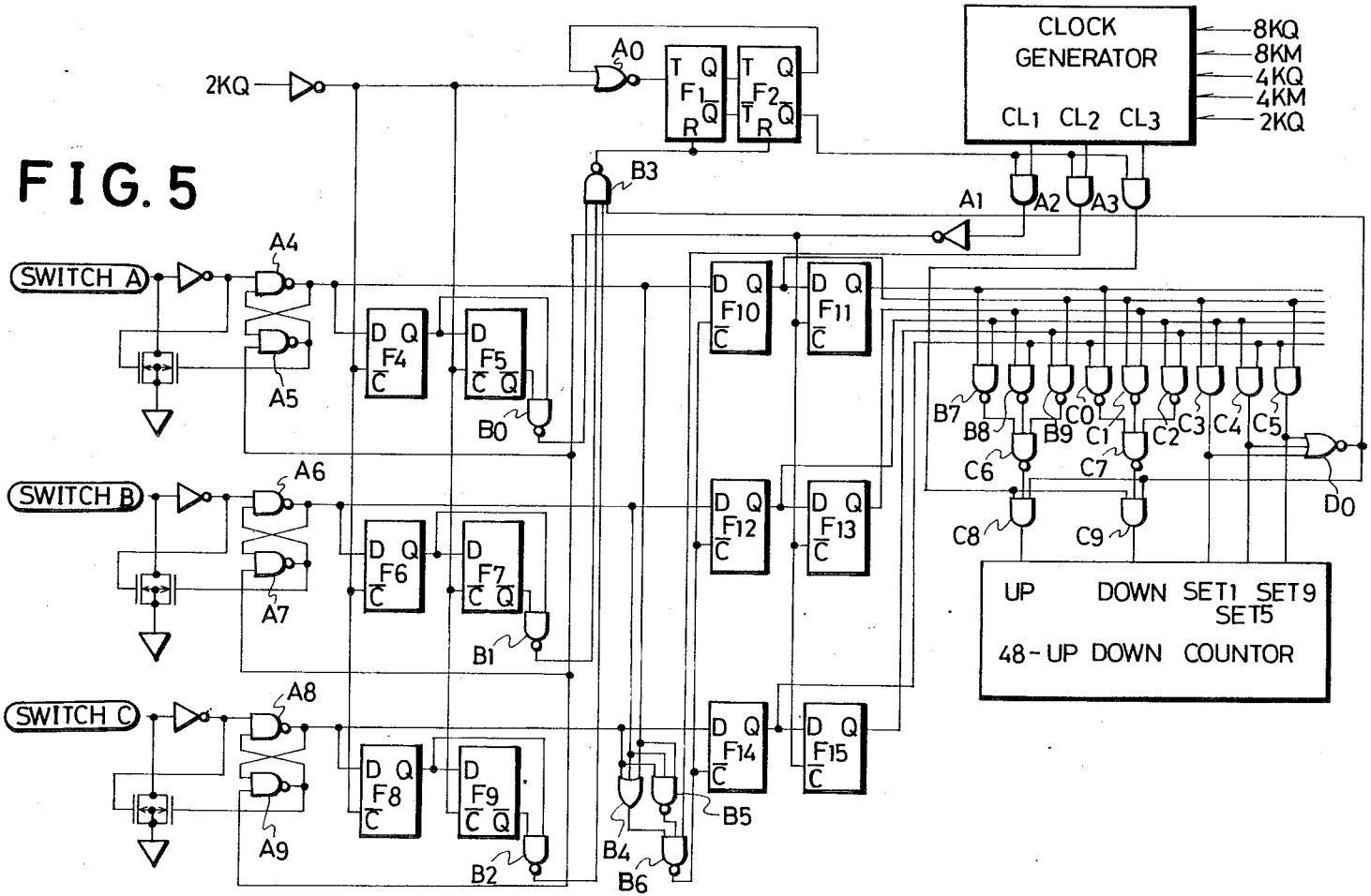
FIG. 5 shows a switch input circuit.

FIG. 5 shows an input circuit where switches A to C operate as in FIG. 4, and the input circuit lets the value of the counter coincide with the position of the annular dial by detecting the rotation direction and the rotation position of the annular dial.

Figure 6:
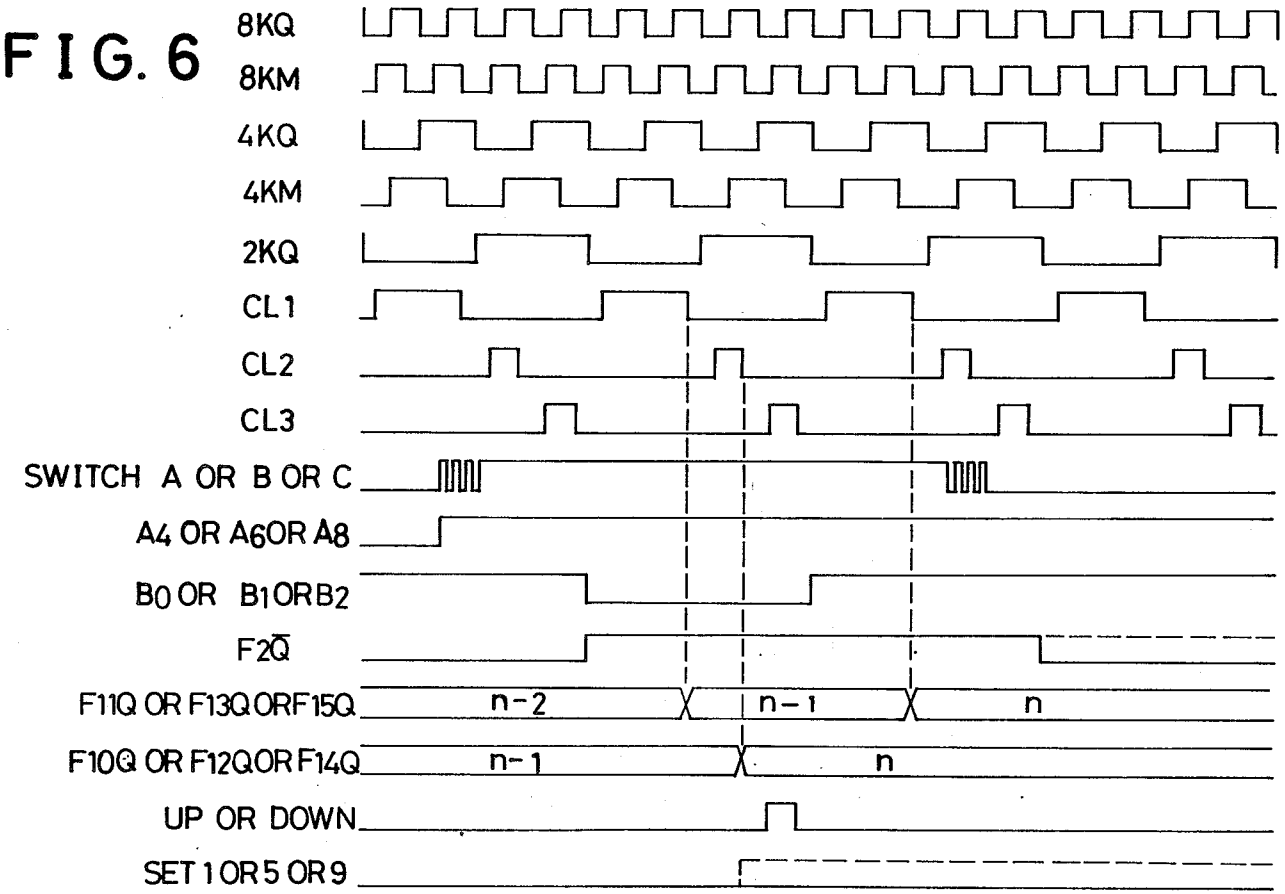
FIG. 6 is a timing chart of the switch input circuit.

The clock generator shown in FIG. 5 always outputs signals CL1 to CL3 as shown in FIG. 6 when setting the sampling frequency of the switches A to C to 2 KHz. Also, the 48 -up down counter shown in FIG. 5 is a counter wherein, when one pulse of active high level is inputted to either the up terminal or to the down terminal, the value of the counter is incremented +1 or decremented −1, when the terminals of SET 1, SET 5, SET 9 become at high level, the content of the counter is respectively set to 1, 5, 9. Moreover, F1, F2 are T (trigger) type flip-flops, F4 to F15 are D (data) type flip-flops, both operating when terminal T or terminal C receives an active low level signal.

The explanation of the operation of the circuit shown in FIG. 5 referring to the timing chart of FIG. 6 is as follows. When switch A, B or C becomes ON, the output of NAND gate A4 to A6 or A8 from R-S latch composed of NAND gates A4 to A9 goes up. Then, a detection circuit consisting of F4, F5, B0 or F6, F7, B1 or F8, F9, B2 operates, and the output of NAND gate B0 or B1 or B2 synchronizes to the going down of the signal 2KQ. When one of the outputs of B0 to B2 starts to go down, F1, F2 flip-flops are reset, and F2Q starts to be high level "Hi". When F2Q becomes "Hi", CL1 to CL3 are outputted to each circuit by AND gates A1 to A3. By the signal CL1, the R-S latch composed of A4 to A9 is reset, and the present ON/OFF data (n) of the switches A to C is latched, and simulatneously, with the start of CL1, the prior data (n−1) latched to F12, F14 is latched to F11, F13, F15. Next, with the start of CL2, the present data (n) latched at the R-S latch composed of A4 to A9 are latched to F10, F12, F14. Then the present data (n) latched at F10, F12, F14 and the former data (n−1) latched at F11, F13, F15 are decoded by a decoding circuit composed of NAND gates B7 to B9, C0 to C7, and then the UP or DOWN signal is outputted to 48 - UP DOWN COUNTER with the timing of CL3. If the present data (n) latched at F10, F12, F14 are (on, on, off), (off, on, on), (on, off, on), terminal SET 1 or 5 or 9 receives a signal and compulsorily sets the 48 - UP DOWN COUNTER to 1, 5, or 9. In this case, the UP DOWN signal is not outputted. When SET 1 or 5 or 9 receives a high level signal, F1, F2 are always reset by the output of NAND gate B3 through NOR gate DO and is set to output CL1 to CL3. This is to detect which one of the switches A to C turns on, that is, to detect the transition of 1(on, on, off) 0(on, off, off), 5(off, on, on) 4(off, on, off) or 9(on, off,on) 8(off, off, on), by resetting the R-S latch composed of A4 to A9, at CL1.

With the above operation, the switch input circuit shown in FIG. 5 detects the ON/OFF operation of switches A to C, and it is possible to let the position of the annular dial, coincide with the value of 48 - UP DOWN COUNTER.

According to the present invention, as a large number of modes are establishable compared to conventional devices, the annular dial is utilizable for other purposes other than time information modes. For example the present invention can be utilized for character-letter selection of memo watches shown in FIG. 1, or for data input of alarm time of alarm watches.

As only three switch pins are necessary, and as the position of the switch pins is freely establishable, the present invention enables great latitude in watch designs.

What is claimed is:

1. An electronic timepiece having a rotary annular dial rotatable in a clickwise manner on a timepiece case, comprising:

an electric pattern disposed on said rotary annular dial and having a toothlike contact portion;

three switch pins coacting with said contact portion to define three switch circuits for producing electric signals when the switch pins make electrical contact with said contact portion; and switch input circuit means responsive to electric signals from said switch circuits for identifying the rotary position of said rotary annular dial, the switch input circuit means having first memory means for memorizing present switch data representative of the present switching state of said switch circuits, second memory means for memorizing prior switch data representative of a prior switching state of said switch circuits, output means connected to said first memory means and said second memory means for generating a signal representative of the rotation direction and the rotation amount of said rotary annular dial, and third memory means connected to receive said signal for memorizing the present postion of said rotary annular dial;

said switch pins and said contact portion being configured and arranged such that when any one of said pins makes electrical contact with said contact portion, the other two pins do not make electrical contact with said contact portion, and when said annular dial is rotated for one click, said pin which was making contact with said contact portion no longer makes contact with said contact portion and one of said two pins which were not making contact with said contact portion does make contact with said contact portion, the pin making contact with said contact portion being determined according to the rotation direction of said annular dial.

2. An electronic timepiece as claimed in claim 1; wherein said toothlike contact portion has a standardization tooth portion for making contact with one of said pins for two clicks, and said switch input circuit means further includes setting means for detecting when two pins make contact with said standardization tooth portion at the same time and for setting predetermined numbers into said third memory means.

* * * * *